United States Patent [19]

Ohki et al.

[11] Patent Number: 4,525,451

[45] Date of Patent: Jun. 25, 1985

[54] COLOR PHOTOGRAPHIC LIGHT-SENSITIVE MATERIAL COMPRISING PHENOL OR NAPHTHOL HAVING SULFAMOYLAMINO GROUP

[75] Inventors: Nobutaka Ohki; Yoshinobu Yoshida, both of Kanagawa, Japan

[73] Assignee: Fuji Photo Film Co., Ltd., Kanagawa, Japan

[21] Appl. No.: 600,732

[22] Filed: Apr. 16, 1984

[30] Foreign Application Priority Data

Apr. 15, 1983 [JP] Japan ..... 58-66629

[51] Int. Cl.[3] ..... G03C 1/06; G03C 1/33; G03C 1/40; G03C 7/26

[52] U.S. Cl. ..... 430/551; 430/372; 430/552; 430/553; 430/542

[58] Field of Search ..... 430/551, 552, 553, 372, 430/542

[56] References Cited

U.S. PATENT DOCUMENTS 2,701,197 2/1955 Thirtle ..... 430/372
4,175,968 11/1979 Credner et al. ..... 430/372 X
4,179,293 12/1979 Hirano et al. ..... 430/551
4,358,532 11/1982 Koyama et al. ..... 430/542 X
4,366,226 12/1982 Hamaoka et al. ..... 430/372 X
4,447,523 5/1984 Ross et al. ..... 430/372 X

*Primary Examiner*—John E. Kittle
*Assistant Examiner*—Mukund J. Shah
*Attorney, Agent, or Firm*—Sughrue, Mion, Zinn, Macpeak & Seas

[57] ABSTRACT

A novel color stain inhibitor is disclosed, which is a compound comprising a phenol or naphthol ring substituted by at least one substituted or unsubstituted sulfamoyl group. Preferred examples of these compounds are represented by the general formula (I):

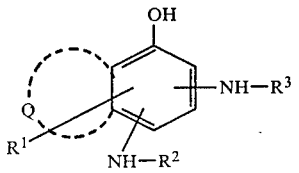

(I)

wherein $R^1$, $R^2$, $R^3$ and Q are as defined herein. In light-sensitive materials containing the color stain inhibitors of the present invention, color stain is efficiently prevented.

13 Claims, No Drawings

COLOR PHOTOGRAPHIC LIGHT-SENSITIVE MATERIAL COMPRISING PHENOL OR NAPHTHOL HAVING SULFAMOYLAMINO GROUP

FIELD OF THE INVENTION

The present invention relates to a color photographic light-sensitive material which is prevented from color staining. More particularly, it is concerned with a silver halide color photographic light-sensitive material containing sulfamoylaminophenol or naphthol derivatives as color stain inhibitors.

BACKGROUND OF THE INVENTION

It is well known that in multi-layer color photographic light-sensitive materials of the type where color-forming couplers are contained in a silver halide photographic light-sensitive emulsion and which are developed with para-phenylenediamine, etc., oxidized color developing agents which are formed at the time of development transfer into adjacent image-forming layers, produce undesirable dyes, i.e., cause the so-called "color turbidity" or "color mixing" phenomenon. It is also known that the undesirable "color fog" phenomenon is caused by aerial oxidation of developing agents, fogging of emulsions, and so forth at the time of color development.

The term "color stain" is used herein to include both the "color turbidity" and "color fog".

In order to prevent the color stain, it has been proposed to use hydroquinones. Various hydroquinones have heretofore been proposed, including mono-straight chain alkylhydroquinones (see, for example, U.S. Pat. No. 2,728,659 and Japanese Patent Application (OPI) No. 106329/74 (the term "OPI" as used herein means a "published unexamined Japanese patent application")), mono-branched alkylhydroquinones (see, for example, U.S. Pat. No. 3,700,453, West German Patent Laid-Open No. 2,149,789, and Japanese Patent Application (OPI) Nos. 156438/75 and 106329/75), di-straight chain alkylhydroquinones (see, for example, U.S. Pat. Nos. 2,728,657, 2,732,300, British Pat. Nos. 752,146 and 1,086,208 and *Chemical Abstract,* Vol. 58, 6367h), and di-branched alkylhydroquinones (see, for example, U.S. Pat. Nos. 3,700,453, 2,732,300, British Pat. No. 1,086,208, *Chemical Abstract,* Vol. 58, 6367h, Japanese Patent Publication Nos. 21249/75, 40818/81, and Japanese Patent Application (OPI) No. 156438/75).

In addition, the use of alkylhydroquinones as color stain inhibitors is described in British Pat. Nos. 558,258, 557,750 (corresponding to U.S. Pat. No. 2,360,290), 557,802, 731,301 (corresponding to U.S. Pat. No. 2,701,197), U.S. Pat. Nos. 2,336,327, 2,403,721, 3,582,333, West German Patent Laid-Open No. 2,505,016 (corresponding to Japanese Patent Application (OPI) No. 110337/75), and Japanese Patent Publication No. 40816/81.

It is also known that in color diffusion transfer photographic light-sensitive materials the color turbidity phenomenon occurs as in the usual color photographic light-sensitive materials. In order to prevent this phenomenon, hydroquinones as described above are used. For example, hydroquinones to be used as color turbidity inhibitors for diffusion transfer light-sensitive materials are described in Japanese Patent Application (OPI) No. 21249/83.

The use of sulfonamidophenols as color turbidity inhibitors for diffusion transfer light-sensitive materials is described in *Research Disclosure,* 15162 (1973), page 83, and Japanese Patent Application (OPI) Nos. 72158/80 and 24941/82 (corresponding to U.S. Pat. No. 4,366,226).

In the field of production of color photographic light-sensitive materials, in order to produce higher quality color photographs, it has recently been strongly desired to develop novel color stain inhibitors which more efficiently prevent color stain without lowering photographic sensitivity, can be added to light-sensitive materials which are reduced in thickness in order to increase sharpness, can be stored for long periods of time withoug causing changes in performance, and further which contribute to improvement of light-fastness of dye images formed by color development.

SUMMARY OF THE INVENTION

An object of the invention is to provide a novel color stain inhibitor.

Another object of the invention is to provide a novel color stain inhibitor which efficiently removes the oxidized products of color developing agents or electron transfer-type black developing agents.

Another object of the invention is to provide a novel color stain inhibitor which can be used in light-sensitive materials reduced in thickness.

Another object of the invention is to provide a novel color stain inhibitor which is free from any change in performance even after long-term storage.

Still another object of the invention is to provide a color photographic light-sensitive material containing the novel color stain inhibitor.

It has been found that the objects are attained by using compounds comprising a phenol or naphthol ring containing at least one substituted or unsubstitued sulfamoylamino substituent as color stain inhibitors.

The present invention relates to a color photographic light-sensitive material characterized by containing a compound comprising a phenol or naphthol ring substituted with at least one substituted or unsubstituted sulfamoylamino group as a color stain inhibitor.

DETAILED DESCRIPTION OF THE INVENTION

Of the compounds which are used as the color stain inhibitors in the present invention, the compounds represented by the general formula (I) are preferred.

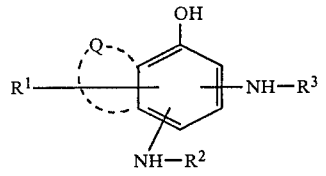

Formula (I)

wherein:

$R^1$ is a hydrogen atom, a halogen atom, or may be a substituted or unsubstituted group selected from the group consisting of an alkyl group, an alkoxyl group, an acylamino group, an alkylthio group, an alkoxycarbonyl group, an aryloxycarbonyl group, a sulfamoylamino group, a carbamoylamino group, an arylsulfonamide group, an alkylsulfonamide group, an acyl group, a sulfonyl group, and a carbamoyl group;

$R^2$ and $R^3$ may be substituted or unsubstituted group selected from the group consisting of an arylsulfonyl group, an alkylsulfonyl group and a sulfamoyl group, provided that when $R^1$ is not a substituted or unsubstituted sulfamoylamino group, at least one of $R^2$ and $R^3$ is a substituted or unsubstituted sulfamoyl group, and Q represents the atoms needed to form a phenol ring in combination with a ring substituted with a OH group or an atomic group to form a naphthol ring in combination with a ring substituted with a OH group.

The compounds of the general formula (I) will be hereinafter be explained in more detail.

In the general formula (I), $R^1$ is;

a hydrogen atom;

a halogen atom (e.g., chlorine, bromine, and fluorine);

an alkyl group which may be substituted by groups such as a halogen atom, a hydroxyl group, and an alkoxyl group, and the total number of carbon atoms of which is preferably from 1 to 15 (e.g., a methyl group, an ethyl group, a tert-butyl group, and a n-pentadecyl group);

an alkoxyl group which may be substituted by groups such as a halogen atom, a hydroxyl group, and an aryl group, and the total number of carbon atoms of which is preferably from 1 to 10 (e.g., a methoxy group, an ethoxy group, and a butoxy group);

an acylamino group which may be substituted by groups such as an alkyl group and an aryl group and the total number of carbon atoms of which is preferably from 2 to 30 (e.g., an acetylamino group, a benzoylamino group, and an α-(2,4-di-tert-amylphenoxy)-propaneamide group);

an alkylthio group which may be substituted by groups such as a halogen atom, a hydroxyl group, and an alkoxyl group, and the total number of carbon atoms of which is preferably from 1 to 20 (e.g., a methythio group, and a hexadecylthio group);

an alkoxycarbonyl group in which the alkoxyl group may be substituted by groups such as a halogen atom, a hydroxyl group, and an aryl group, and the total number of carbon atoms of which is preferably from 2 to 20 (e.g., a methoxycarbonyl group and an ethoxycarbonyl group);

an aryloxycarbonyl group in which the aryl group may be substituted by groups such as alkyl group and an alkoxy group, and the total number of carbon atoms of which is preferably from 7 to 30 (e.g., a phenoxycarbonyl group);

a sulfamoylamino group in which the sulfamoyl group may be substituted by groups such as an alkyl group and an aryl group, and the total number of carbon atoms of which is preferably from 0 to 20 (e.g., a $NH_2SO_2NH$— group, and an N,N-dipropylsulfamoylamino group);

a carbamoylamino group in which the carbamoyl group may be substituted by groups such as an alkyl group, and an aryl group, and the total number of carbon atoms of which is preferably from 2 to 20 (e.g., a $NH_2CONH$— group and an N-phenylcarbamoylamino group);

an arylsulfonamide group in which the aryl group may be substituted by groups such as an alkoxyl group and an alkyl group, and the total number of carbon atoms of which is preferably from 6 to 30 (e.g., 4-(n-dodecyloxy)phenylsulfonamide group, a p-tolylsulfonamide group, and a 4-dodcylphenylsulfonamide group);

an alkylsulfonamide group in which the alkyl group may be substituted by groups such as a halogen atom, a hydroxyl group, and an alkoxyl group, and the total number of carbon atoms of which is preferably from 1 to 20 (e.g., a methanesulfonamide gorup and a n-octanesulfonamide group);

an acyl group which preferably has an alkyl or aryl group containing 1 to 20 carbon atoms (e.g., an acetyl group and an ethylcarbonyl group);

a sulfonyl group which preferably has an alkyl or aryl group containing 1 to 20 carbon atoms (e.g., a p-toluenesulfonyl group); or a carbamoyl group which preferably contains an alkyl or aryl group containing 1 to 20 carbon atoms (e.g., a di-n-octylcarbamoyl group).

$R^2$ and $R^3$ may be the same or different, and are each;

an arylsulfonyl group in which the aryl group may be further substituted by groups such as an alkyl group and an alkoxyl group, and the total number of carbon atoms of which is from 6 to 30 (e.g., a 4-(n-dodecyloxy)-phenylsulfonyl group, a p-trisulfonyl group, and a p-dodecylphenylsulfonyl group);

an alkylsulfonyl group in which the alkyl group may be substituted by groups such as a chlorine atom, a bromine atom and a hydroxy group, and the total number of carbon atoms of which is from 1 to 20 (e.g., a methanesulfonyl group, a n-octanesulfonyl group, and a n-hexadecanesulfonyl group); or a sulfamoyl group which may be further substituted by groups such as an alkyl group and an aryl group, and the total number of carbon atoms of which is from 0 to 20 (e.g., a N,N-dipropylsulfamoyl group and an N,N-dimethylsulfamoyl group), provided that when $R^1$ is not a sulfamoylamide group, at least one of $R^2$ and $R^3$ is a sulfamoyl group.

The OH group is substituted in the benzene ring or the naphthalene ring which is formed from the benzene ring and the atomic group Q. The groups —$R^1$, —$NHR^2$ and —$NHR^3$ may be substituted in any position of the benzene or naphthalene ring.

Of the compounds of the general formula (I), the compounds represented by the following general formulae (II) to (V) are preferred.

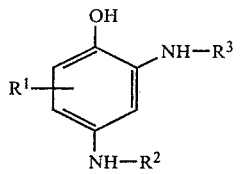

(II)

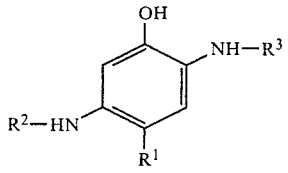

(III)

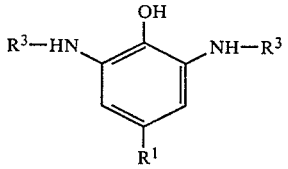

(IV)

-continued (V)

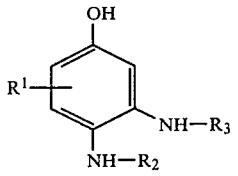

In the general formulae (II) to (V), $R^1$, $R^2$ and $R^3$ are as defined in the general formula (I).

Of the compounds of the general formulae (I) to (V), those compounds in which the total number of carbon atoms of $R^1$, $R^2$ and $R^3$ is at least 10 are preferred since they move less from the layer to which they have been added to other layers.

In the general formula (II) or (V), $R^1$ is preferably a hydrogen atom, an alkyl group, an alkoxyl group, a halogen atom, an acyl group, an alkylthio group, an alkoxycarbonyl group, an aryloxycarbonyl group, or a carbamoyl group.

In the general formula (III) or (IV), $R^1$ is preferably a hydrogen atom, an alkyl group, an alkoxycarbonyl group, an aryloxycarbonyl group, an acyl group, or a carbamoyl group. More preferred are those groups which are not released from the phenol or naphthol ring at the time of color development, such as an alkyl group, an alkoxycarbonyl group, an aryloxycarbonyl group, an acyl group, and a carbamoyl group (provided that this is not applicable to a case in which the compounds of the present invention are to be used in a color diffusion transfer process).

Of the compounds as described above, the compounds of the general formulae (II), (III) and (IV) are preferred. The compounds of the general formulae (II) and (III) are especially preferred. Most preferred are the compounds of the general formula (II).

When the compounds of the present invention are used in an intermediate layer as color turbidity inhibitors, it is preferred for them to be used in an amount of from $1.0\times10^{-3}$ to $1.0\times10^{-5}$ mol/m$^2$ per one layer. When they are added to an emulsion layer as anti-color-foggants, it is preferred for them to be used in an amount of from $1.0\times10^{-4}$ to $1.0\times10^{-6}$ mol/m$^2$ per one layer. It is to be noted that the present invention is not limited to these ranges only. Furthermore, the compounds of the present invention can be added to both the intermediate layer and the emulsion layer so that they serve to prevent the color turbidity and color fog simultaneously.

Typical examples of the compounds of the general formula (I) are shown below, although the present invention is not limited thereto.

(1)

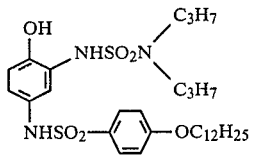

(2)

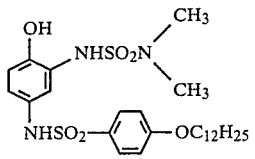

-continued (3)

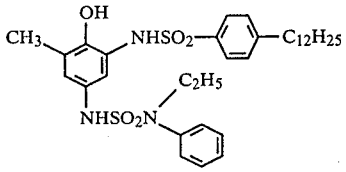

(4)

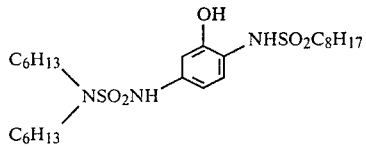

(5)

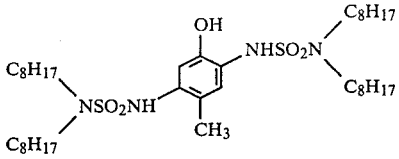

(6)

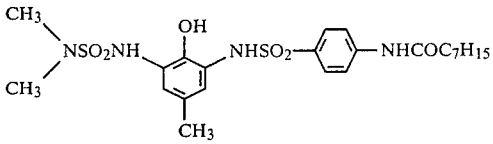

(7)

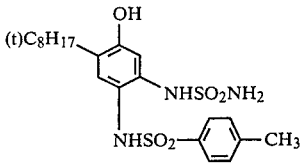

(8)

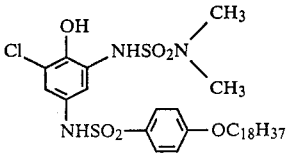

(9)

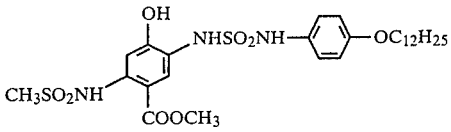

(10)

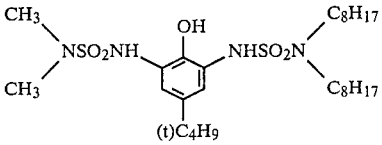

(11)

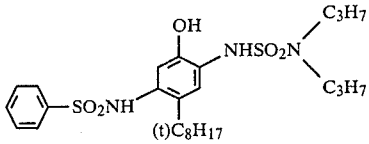

(12)

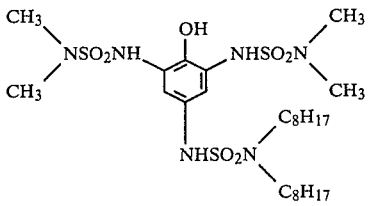

-continued (13)

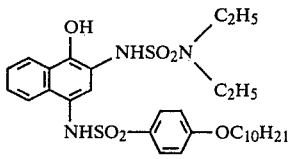

(14)

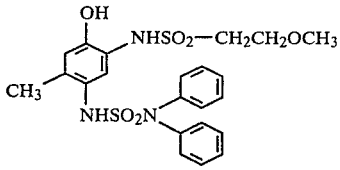

(15)

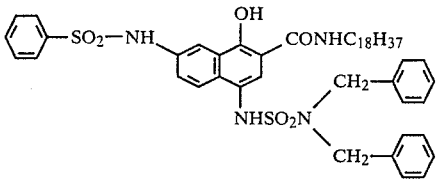

(16)

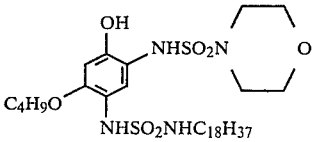

(17)

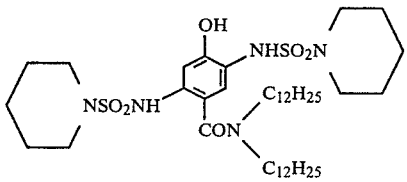

(18)

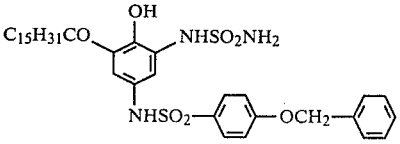

(19)

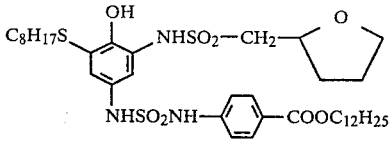

(20)

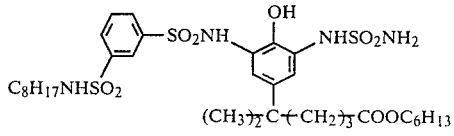

(21)

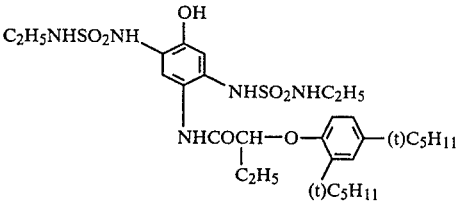

-continued (22)

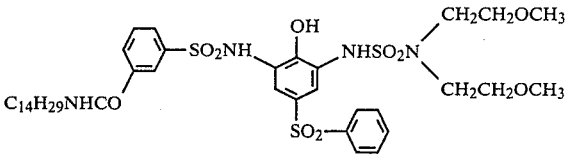

(23)

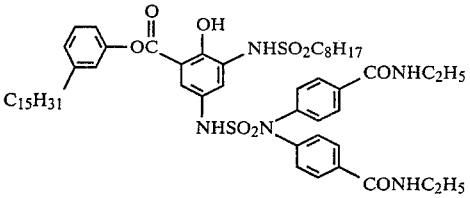

(24)

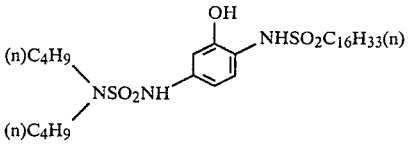

(25)

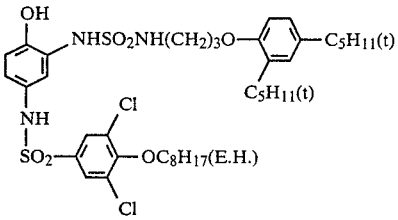

The compounds of the general formula (I) can be prepared by the following reaction sequence generally using substituted aminonitrophenols as starting materials.

(18)

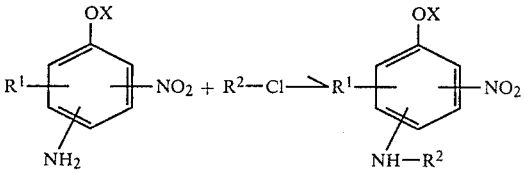

(19)

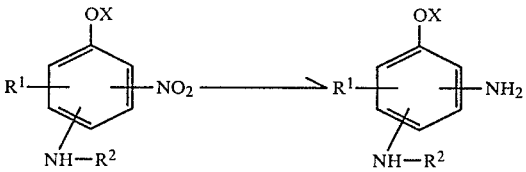

(20)

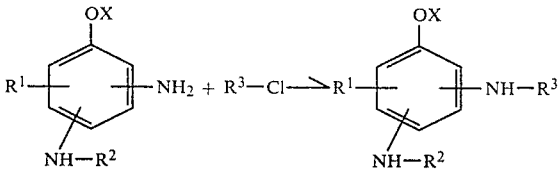

In the above formulae, $R^1$, $R^2$ and $R^3$ are the same as defined in the general formula (I). X is a group known as a protective group for hydrogen or a hydroxyl group (e.g., a benzyl group). If necessary, this protective group can be introduced prior to the reaction and removed after the reaction is completed. $R^2$—Cl and $R^3$—Cl are acid chlorides derived from acids containing $R^2$ and $R^3$ radicals, respectively.

The first and second reactions as described above are each an amidization reaction between aniline and an acid chloride. This reaction is generally carried out in non-protonic polar solvents (e.g., acetonitrile, dimethylformamide, and dimethylacetamide) in the presence of acidremoval agents (e.g., triethylamine, pyridine, 4-(dimethylamino)pyridine, and DBU). However, in a case where X is hydrogen, the acid-removing agent is preferably a reagent of low basicity (e.g., pyridine) in order to obtain high reaction selectivity. The reaction temperature is preferably from 0° C. to the reflux temperature of the solvent used.

The second reaction is a reduction reaction of a nitro group into an amino group. This reaction can be generally carried out by catalytic hydrogenation using hydrogen or reduction using metals (e.g., tin and iron).

Examples of preparation of the compounds of the present invention are shown below.

SYNTHESIS EXAMPLE 1

Preparation of Compound (1)

Step 1

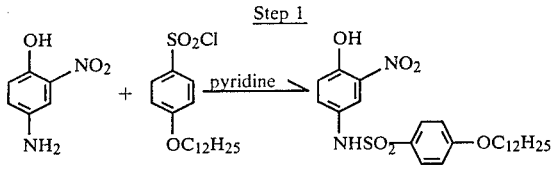

Aniline A (15.4 g) was dissolved in 80 ml of pyridine and stirred, and 36.1 g of solid sulfonyl chloride B was added thereto. Some heat generation was observed. The mixture was heated at the reflux temperature for 1 hour and then was allowed to cool. The mixture was gradually poured into 500 ml of ice water containing 100 ml of concentrated hydrochloric acid while stirring. Crystals that precipitated were collected, washed with water, and dried, yielding 47 g of yellow crystals.

Step 2

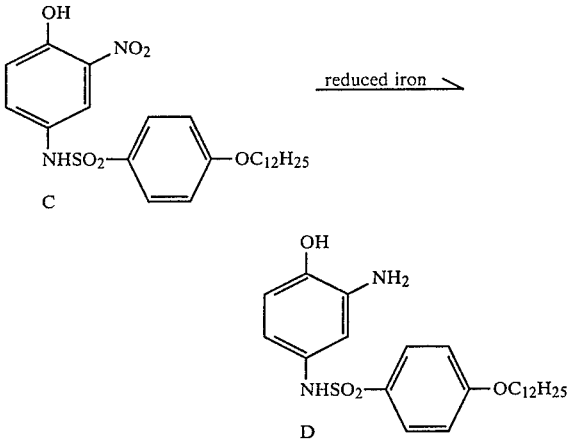

A mixture of 47 g of nitrophenol C and 25 g of reduced iron was placed in 200 ml of iso-propanol, and the resulting mixture was refluxed by heating with stirring. Then 10 ml of concentrated hydrochloric acid was graddually added dropwise, stirred for 30 minutes, and was allowed to cool. A mixture of 300 ml of ethyl acetate and 300 ml of a 5% aqueous sodium bicarbonate solution was added thereto. Solids were separated by filtration. The ethyl acetate layer was separated, washed with water, and then concentrated to yield black brown crude crystals. By a treatment with activated carbon followed by recrystallization from methanol, 39 g of light brown crystals D were obtained.

Step 3

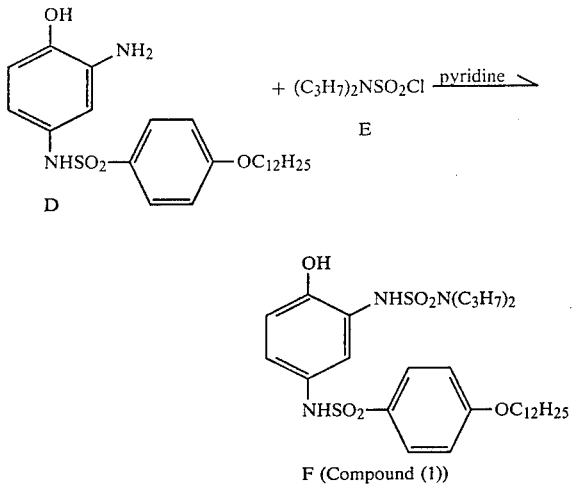

Aminophenol D (22.4 g) was dissolved in 80 ml of pyridine and stirred, and 10.0 of sulfamoylchloride E was added thereto. The resulting mixture was then heated at the reflux temperature for 1 hour and was allowed to stand for a certain period of time. The mixture was gradually poured into 500 ml of ice water containing 100 ml of concentrated hydrochloric acid while stirring. Crystals precipitated were collected by filtration, washed with water, and then dried to yield crude crystals. By a treatment with activated carbon followed by recrystallization from acetonitrile, 25 g of white crystals F were obtained.

| Elemental analysis: | C | H | N |
|---|---|---|---|
| Calculated for $C_{30}H_{49}N_3O_6S_2$ | 58.89 | 8.16 | 6.87 |
| Found | 59.02 | 8.17 | 6.83 |

SYNTHESIS EXAMPLE 2

Preparation of Compound (2)

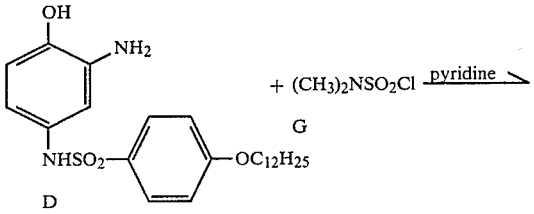

-continued

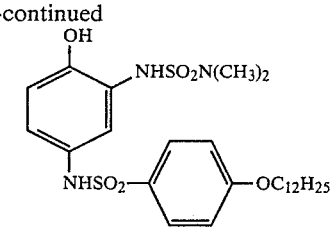

H (Compound (2))

Using 22.4 g of aminophenol D and 7.2 g of sulfamoylchloride G, 20 g of white crystals H were obtained in the same manner as in the step 3 of Synthesis Example 1.

| Elemental analysis: | C | H | N |
|---|---|---|---|
| Calculated for $C_{26}H_{41}N_3O_6S_2$ | 56.19 | 7.44 | 7.56 |
| Found | 56.03 | 7.21 | 7.52 |

The compounds of the present invention can be introduced into the light-sensitive constituting layers such as an emulsion layer and an intermediate layer by known methods which are commonly used for the incorporation of couplers into emulsion layers. For example, the compounds are first dissolved in phthalic acid alkyl esters (e.g., dibutyl phthalate and dioctyl phthalate), phosphoric acid esters (e.g., diphenyl phosphate, triphenyl phosphate, tricresyl phosphate, and dioctylbutyl phosphate), citric acid esters (e.g., tributyl acetylcitrate), benzoic acid esters (e.g., octyl benzoate), alkylamides (e.g., diethylaurylamide), fatty acid esters (e.g., dibutoxyethyl succinate and dioctyl azelate), trimesic acid esters (e.g., tributyl trimesicate), or organic solvents having a boiling point ranging between about 30° and 150° C., such as a lower alkyl acetate (e.g., ethyl acetate and butyl acetate), ethyl propionate, sec-butyl alcohol, methyl isobutyl ketone, β-ethoxyethyl acetate, and methyl cellosolve acetate, and then dispersed in hydrophilic colloids. The above-described high-boiling and low-boiling organic solvents may be used in combination with each other.

The compounds of the present invention are greatly effective in preventing color stain of silver halide color photographic light-sensitive materials of the type where dye images are formed upon oxidative coupling of aromatic primary amine developing agents (e.g., phenylenediamine derivatives and aminophenol derivatives) and color-forming couplers at the process of color development.

In color photographic light-sensitive materials of the type as described above, the following color-forming couplers can be used, as magenta couplers, a 5-pyrazolone coupler, a pyrazolobenzimidazole coupler, a cyanoacetylcumarone coupler, an open-chain acylacetonitrile coupler, etc.; as yellow couplers, an acylacetamide coupler (e.g., benzoylacetanilides and pivaloylacetanilides); and as cyan couplers, a naphthol coupler and a phenol coupler. These can be made non-diffusing by introducing a hydrophobic group called a ballast group into the molecule or linking it to the polymer chain. These non-diffusing couplers are preferably used in the present invention.

The couplers may be either four-equivalent or two-equivalent relative to silver ion. In addition, colored couplers having the effect of color correction, or so-called DIR couplers releasing a development inhibitor with the progress of development can be used.

Typical examples of magenta couplers are described in, for example, U.S. Pat. Nos. 2,600,788, 2,983,608, 3,062,653, 3,127,269, 3,311,476, 3,419,391, 3,519,429, 3,558,319, 3,582,322, 3,615,506, 3,834,908, 3,891,445, West German Pat. No. 1,810,464, West German Patent Application (OLS) Nos. 2,408,665, 2,417,945, 2,418,959, 2,424,467, Japanese Patent Publication No. 6031/65, Japanese Patent Application (OPI) Nos. 20826/76, 58922/77, 129538/74, 74027/74, 159336/75, 42121/77, 74028/74, 60233/75, 26541/76, and 55122/78.

Typical examples of yellow couplers are described in, for example, U.S. Pat. Nos. 2,875,057, 3,265,506, 3,408,194, 3,551,155, 3,582,322, 3,725,072, 3,891,445, West German Pat. No. 1,547,868, West German Patent Laid-Open Nos. 2,219,917, 2,261,361, 2,414,006, British Pat. No. 1,425,020, Japanese Patent Publication No. 10783/76, Japanese Patent Application (OPI) Nos. 26133/72, 73147/73, 102636/76, 6341/75, 123342/75, 130442/75, 21827/76, 87650/75, 82424/77, and 115219/77.

Typical examples of cyan couplers are described in, for example, U.S. Pat. Nos. 2,369,929, 2,434,272, 2,474,293, 2,521,908, 2,895,826, 3,034,892, 3,311,476, 3,458,315, 3,476,563, 3,583,971, 3,591,383, 3,767,411, 4,004,929, West German Patent Application (OLS) Nos. 2,414,830, 2,454,329, Japanese Patent Application (OPI) Nos. 59838/73, 26034/76, 5055/73, 146828/76, 69624/77, and 90932/77.

Colored couplers which can be used are described in, for example, U.S. Pat. Nos. 3,476,560, 2,521,908, 3,034,892, Japanese Patent Publication Nos. 2016/69, 22335/63, 11304/67, 32461/69, Japanese Patent Publication (OPI) Nos. 26034/76, 42121/77, and West German Patent Application (OLS) No. 2,418,959.

DIR couplers which can be used are described in, for example, U.S. Pat. Nos. 3,227,554, 3,617,291, 3,701,783, 3,790,384, 3,632,345, West German Patent Application (OLS) Nos. 2,414,006, 2,454,301, 2,454,329, British Pat. No. 953,454, Japanese Patent Application (OPI) Nos. 69624/77, 122335/74, and Japanese Patent Publication No. 16141/76.

The color stain inhibitors of the present invention are useful for prevention of color stain in the so-called diffusion transfer type silver halide color photographic light-sensitive materials. Dye image-forming compounds for use in these light-sensitive materials include dye developing agents, dye-releasing redox compounds, and DDR couplers. More specifically, the compounds described in, for example, U.S. Pat. Nos. 4,053,312, 4,055,428, 4,076,529, 4,152,153, 4,135,929, Japanese Patent Application (OPI) Nos. 149328/78, 104343/76, 46730/78, 130122/79, 3819/78, Japanese Patent Application Nos. 89128/79, 90806/79, and 91187/79 can be used.

The compounds of the present invention may be used in combination with known color stain inhibitors such as hydroquinone derivatives, aminophenol derivatives, gallic acid derivatives, and ascorbic acid derivatives.

Typical examples of such known color stain inhibitors are described in, for example, U.S. Pat. Nos. 2,360,290, 2,336,327, 2,403,721, 2,418,613, 2,675,314, 2,701,197, 2,704,713, 2,728,659, 2,732,300, 2,735,365, Japanese Patent Application (OPI) Nos. 92988/75, 92989/75, 93928/75, 110337/75, 146235/77, and Japanese Patent Publication No. 23813/75.

The light-sensitive material of the present invention may contain ultraviolet absorbers in the hydrophilic colloid layer thereof. Ultraviolet absorbers which can be used include aryl group-substituted benzotriazole, 4-thiazolidone, benzophenone, cinnamate, butadiene, and benzooxazole compounds, and ultraviolet ray-absorbing polymers. These ultraviolet absorbers may be fixed in the above-described hydrophilic colloid layer.

With regard to photographic silver halide emulsions which can be used in the color light-sensitive material of the present invention and their methods of preparation, and photographic additives (or photographic elements), reference can be made to *Research Disclosure,* No. 176 (November 1978), pages 22–31, "Preparation and Type of Emulsion", "Rinsing of Emulsion", "Chemical Sensitization", "Antifoggants and Stabilizers", "Hardening Agents", "Support", "Plasticizers and Lubricants", "Coating Aids", "Matting Agents", "Sensitizers", "Spectral Sensitizers", "Method of Addition", "Absorption and Filter Dyes", and "Method of Coating".

Formation of color images can be achieved by techniques such as the negative positive process (described in, for example, *Journal of the Society of Motion Picture and Television Engineers,* Vol. 61 (1953, pages 667–701), the color reversal process in which a negative silver image is formed by developing with a developer containing a black and white developing agent and, thereafter, the negative silver image is subjected to at least one uniform exposure or other suitable fogging treatment and subsequently is color developed to form a positive dye image, and the silver dye bleach process in which a photographic emulsion layer containing dye is exposed and then exposed to form a silver image, and with the thus-formed silver image as a bleach catalyst, the dye is bleached.

A color developer is generally composed of an alkaline aqueous solution containing a color developing agent. As color developing agents, known primary aromatic amine developers such as phenylenediamines (e.g., 4-amino-N,N-dimethylaniline, 3-methyl-4-amino-N,N-diethylaniline, 4-amino-N-ethyl-N-$\beta$-hydroxyethylaniline, 3-methyl-4-amino-N-ethyl-N-$\beta$-hydroxyethylaniline, 3-methyl-4-amino-N-ethyl-N-$\beta$-methanesulfoamideethylaniline, and 4-amino-3-methyl-N-ethyl-N-$\beta$-methoxyethylaniline) can be used.

In addition, the compounds described in L. F. A. Mason, *Photographic Processing Chemistry,* published by Focal Press Co., (1966), pages 226–229, U.S. Pat. Nos. 2,193,015, 2,592,364, and Japanese Patent Application (OPI) No. 64933/73 may be used.

The color developer can further contain pH buffers such as sulfurous acid salts, carbonic acid salts, boric acid salts, and phosphoric acid salts of alkali metals, development inhibitors or antifoggants such as bromides, iodides, and organic antifoggants, and so forth. If necessary, the color developer may contain a hard water-softening agent, a preservative (e.g., hydroxylamine), an organic solvent (e.g., benzyl alcohol and diethylene glycol), a development accelerator (e.g., polyethylene glycol, quaternary ammonium salts, and amines), a dye-forming coupler, a competitive coupler, a fogging agent (e.g., sodium borohydride), an auxiliary developing agent (e.g., 1-phenyl-3-pyrazolidone), a tackifier, a polycarboxylic acid-based chelating agent as described in U.S. Pat. No. 4,083,723, and an antioxidant as described in West German Patent Application (OLS) No. 2,622,950.

After color development, the photographic emulsion layer is usually bleached. This bleaching may be performed simultaneously with fixing, or it may be performed separately. Bleaching agents which can be used include compounds of polyvalent metals such as iron (III), cobalt (III), chromium (VI) and copper (II), peracids, quinones, and nitroso compounds. For example, ferricyanides, perchromic acid salts, organic complex salts of iron (III) or cobalt (III), such as complex salts of aminopolycarboxylic acids such as ethylenediaminetetraacetic acid, nitrirotriacetic acid, and 1,3-diamino-2-propanoltetraacetic acid, or organic acids such as citric acid, tartaric acid and malic acid, persulfuric acid salts, permanganic acid salts, and nitrosophenol can be used. Of these compounds, potassium ferricyanide, sodium iron (III) ethylenediaminetetraacetate, and iron (III) ammonium ethylenediaminetetraacetate are particularly ueseful. An ethylenediaminetetraacetic acid iron (III) complex salt is useful in both an independent bleaching solution and a combined bleach-fixing solution.

To these bleaching or bleach-fixing solutions can be added bleach accelerators as described in U.S. Pat. Nos. 3,042,520, 3,241,966, Japanese Patent Publication Nos. 8506/70 and 8836/70, thiol compounds as described in Japanese Patent Application (OPI) No. 65732/78, and other various additives.

When the light-sensitive material of the present invention is used in a diffusion transfer process, it can be processed with a viscous developer.

This viscous developer is a liquid composition containing ingredients necessary for development of silver halide emulsions and formation of diffusion transfer dye images. The solvent is composed mainly of water and, in some cases, contain hydrophilic solvents such as methanol and methylcellosolve. This composition contains sufficient amounts of alkalis to maintain the pH at a level necessary to cause development of emulsion layers and to neutralize acids (e.g., hydrohalogenic acids such as hydrobromic acid and carboxylic acids such as acetic acid) formed at steps such as development and formation of dye images. Alkalis which can be used include alkali or alkaline earth metal salts such as lithium hydroxide, sodium hydroxide, potassium hydroxide, a calcium hydroxide dispersion, tetramethylammonium hydroxide, sodium carbonate, trisodium phosphate, and amines such as diethylamine. Preferably caustic alkali is added in a concentration such that the pH is at least 12, particularly at least 14, at room temperature. More preferably hydrophilic polymers of high molecular weight such as polyvinyl alcohol, hydroxyethyl cellulose, and sodium carboxymethyl cellulose are added to the composition. These polymers are preferably added in an amount such that the viscosity of the resulting composition is at least 1 poise, particularly several hundred (500–600) to 1,000 poises at room temperature.

The present invention is described in detail with reference to the following examples.

EXAMPLE 1

Preparation of Film A

Support: A baryta paper support coated by polyethylene on both surfaces

First Layer: a blue-sensitive silver chlorobromide emulsion layer with a thickness of 3.0$\mu$ Yellow coupler: α-Pivaloyl-α(2,4-dioxo-5,5'-dimethyloxazolidine-3-yl)-2-chloro-5-[α-(2,4-di-tert-pentylphenoxy)butaneamido]acetoanilide
Amount of coupler coated: $0.646\times10^{-3}$ mol/m$^2$
Amount of silver coated: $3.88\times10^{-3}$ mol/m$^2$
Silver bromide: 70 mol%
Silver chloride: 30 mol%
Second layer: a gelatin layer with a thickness of 1.5μ
Third layer: a gelatin layer containing a magenta coupler, 1-(2,4,6-trichlorophenyl)-3-(2-chloro-(5-tetradecaneamido)anilino}-5-pyrazolone, with a thickness of 3.1μ
Amount of coupler coated: $0.500\times10^{-3}$ mol/m$^2$ Preparation of Film B Film B is the same as Film A except that the second layer contains 2,5-di-tert-octylhydroquinone (amount of the hydroquinone coated: $1.59\times10^{-4}$ mol/m$^2$)

In addition, Films C to F were prepared as follows:

Preparation of Film C

Film C is the same as Film A except that the second layer contains Compound (1) of the present invention (amount of the compound coated: $1.59\times10^{-4}$ mol/m$^2$).

Preparation of Film D

Film D is the same as Film C above except that the amount of the compound coated is $8.0\times10^{-5}$ mol/m$^2$.

Preparation of Film E

Film E is the same as Film C above except that the amount of the compound coated is $4.0\times10^{-5}$ mol/m$^2$.

Preparation of Film F

Film F is the same as Film A except that the second layer contains Compound (8) of the present invention (amount of the compound coated: $8.0\times10^{-5}$ mol/m$^2$).

These Films A to F were exposed to light through a wedge continuously varying in gray density and then processed as follows:

| | |
|---|---|
| Color development | 3.5 minutes at 33° C. |
| Bleach-fixing | 1.5 minutes at 33° C. |
| Rinsing | 3 minutes at 28-35° C. |

| Composition of Color Developer | |
|---|---|
| Benzyl alcohol | 14 ml |
| Diethylenetriaminepentaacetatic acid | 5 g |
| KBr | 0.4 g |
| $Na_2SO_3$ | 5 g |
| $Na_2CO_3$ | 30 g |
| Hydroxylamine sulfate | 2 g |
| 4-Amino-3-methyl-N—β-(methanesulfonamido)ethylaniline.3/2$H_2SO_4$.$H_2O$ | 4.5 g |
| Water to make | 1,000 ml (pH, 10.1) |
| **Bleach-fixing solution** | |
| Ammonium thiosulfate (70% by weight) | 150 ml |
| $Na_2SO_3$ | 5 g |
| Na[Fe(EDTA)] | 40 g |
| EDTA | 4 g |
| Water to make | 1,000 ml (pH, 6.8) |

Each developed sample was measured for the density (magenta color density) by the use of a green filter. The magenta color mixing of the yellow colored area was determined by measuring the difference in magenta density between at the maximum yellow color density and the minimum yellow color density. The results are shown in Table 1 below.

TABLE 1

| Film No. | Compound Type | Compound Amount (mol/m$^2$) | Color Mixing |
|---|---|---|---|
| A | — | — | 0.73 |
| B | 2,5-Di-tert-octyl-hydroquinone | $1.59\times10^{-4}$ | 0.25 |
| C | (1) | $1.59\times10^{-4}$ | 0.18 |
| D | " | $8.0\times10^{-5}$ | 0.21 |
| E | " | $4.0\times10^{-5}$ | 0.25 |
| F | (8) | $8.0\times10^{-5}$ | 0.22 |

In the "color mixing" column, as the value is smaller, the color mixing is more reduced. Thus, it is apparent that the compounds of the present invention are superior in preventing color mixing (color fog) and are sufficiently effective even when added in small amounts.

EXAMPLE 2

Preparation of Film A

Film A was prepared by coating a blue-sensitive silver chlorobromide emulsion layer (yellow coupler: α-pivaloyl-α(2,4-dioxo-5,5'-dimethyloxazolidine-3-yl)-2-chloro-5-[α-(2,4-di-tert-pentylphenoxy)-butylamido]acetanilide) in a dry layer thickness of 3μ (amount of the coupler coated: $0.646\times10^{-3}$ mol/m$^2$; amount of silver coated: $3.88\times10^{-3}$ mol/m$^2$; the halogen composition of the silver chlorobromide: 70 mol% silver bromide and 30 mol% silver chloride) on a baryta paper support coated by polyethylene on both surfaces, and further coating thereon a gelatin layer in a dry layer thickness of 1μ.

Preparation of Films B to E

Films B to E were prepared in the same manner as in the preparation of Film A except that in addition to the above yellow coupler $0.02\times10^{-3}$ mol/m$^2$ of Compounds (1), (2), (6), and (11) are added, respectively.

These film samples were exposed to light through a wedge continuously varying in gray density and then processed in the same manner as in Example 1 except that the color development was performed at 38° C. for 3 minutes. The yellow density was then measured to determine the maximum density (Dmax) and minimum density (Dmin). The results are shown in Table 2 below.

TABLE 2

| Film No. | Compound | Dmax | Dmin |
|---|---|---|---|
| A | — | 2.13 | 0.25 |
| B | (1) | 2.01 | 0.19 |
| C | (2) | 2.05 | 0.20 |
| D | (6) | 1.97 | 0.19 |
| E | (11) | 2.03 | 0.21 |

It can be seen from the results shown in Table 2 that Films B to E containing the compounds of the present invention are lower in minimum density than Film A and are improved in color fog compared with Film A.

The same film samples as above (Films A to E) were stored for 3 days under the conditions of 50% relative humidity and 50° C. prior to exposure and then processed in the same manner as above. In Film A, a decrease in the maximum density and an increase in the minimum density were observed. In Films B to E, on the other hand, changes in the maximum and minimum densities were very small.

EXAMPLE 3

Film A

The following emulsion layers and auxiliary layers were coated on a triacetyl cellulose support in the sequence shown below:

First Layer (Low-Sensitivity Red-Sensitive Emulsion Layer)

A cyan coupler, 2-heptafluorobutylamido-5-{2'-(2'',4''-di-tert-amil-phenoxy)butylamido}phenol (100 g) was dissolved in a mixed solvent of 100 ml of tricresyl phosphate and 100 ml of ethyl acetate, mixed with 1 kg of a 10% aqueous gelatin solution. Then, the obtained cyan coupler emulsion was mixed with 1 Kg of red-sensitive silver iodobromide emulsion. (containing 70 g of silver and 60 g of gelatin, and 4.5 mol% of iodine), and then coated in a dry layer thickness of 2μ.

Second Layer (High-Sensitivity Red-Sensitive Emulsion Layer)

The same cyan coupler emulsion as used in the first layer (1,000 g) was mixed with 1 kg of a red-sensitive high sensitivity silver iodobromide emulsion (silver: 70 g; gelatin 60 g; iodo content: 4.5 mol%) and then coated in a dry layer thickness of 2μ.

Third Layer (Intermediate Layer)

2,5-Di-tert-octylhydroquinone (50 g) was dissolved in a mixed solvent of 100 ml of dibutyl phthalate and 100 ml of ethyl acetate and emulsified in 1 kg of a 10% aqueous gelatin solution to prepare an emulsion. Then 700 g of the emulsion was mixed with 1 kg of 10% gelatin and coated in a dry layer thickness of 1.2μ.

Fourth Layer (Low-Sensitivity Green-Sensitive Emulsion Layer)

An emulsion (500 g) which had been prepared in the same manner as in the preparation of the first layer except that 125 g of a magenta coupler, 1-(2,4,6-trichlorophenyl)-3-{3-(2,4-di-tert-amylphenoxyacetamido)benzamido}-5-pyrazolidone was used was mixed with 1 kg of a green-sensitive silver iodobromide emulsion (containing 70 g of silver and 60 g of gelatin, and 2.5 mol% of iodine) and then coated in a dry layer thickness of 2.0μ.

Fifth Layer (High-Sensitivity Green-Sensitive Emulsion Layer)

The same magenta coupler emulsion as used in the fourth layer (1,000 g) was mixed with 1 kg of a green-sensitive high sensitivity silver iodobromide emulsion (containing 70 g of silver and 60 g of gelatin, and 2.5 mol% of iodine) and then coated in a dry layer thickness of 2μ.

Sixth Layer (Intermediate Layer)

The same emulsion as used in the third layer (700 g) was mixed with 1 kg of 10% gelatin and then coated in a dry layer thickness of 0.9μ.

Seventh Layer (Yellow Filter Layer)

A gelatin solution containing yellow colloid silver was coated in a dry layer thickness of 1μ.

Eighth Layer (Low-Sensitivity Blue-Sensitive Emulsion Layer)

An emulsion (800 g) which had been prepared in the same manner as in the preparation of the first layer except that 70 g of a yellow coupler, α-(pivaloyl)-α-(1-benzyl-5-ethoxy-3-hydantoinyl)-2-chloro-5-dodecyloxycarbonylacetanilide was used was mixed with 1 kg of a blue-sensitive silver iodobromide emulsion (containing 70 g of silver and 60 g of gelatin, and 2.5 mol% of iodine), and then coated in a dry layer thickness of 2.0μ.

Ninth Layer (High-Sensitivity Blue-Sensitive Emulsion Layer)

The same emulsion as used in the eighth layer (100 g) was mixed with 1 kg of a high-sensitivity silver iodobromide emulsion (containing 70 g of silver and 60 g of gelatin, and 2.5 mol% of iodine), and then coated in a dry layer thickness of 2.0μ.

Tenth Layer (Second Protective Layer)

The same emulsion as used in the third layer (1 kg) was mixed with 1 kg of 10% gelatin and then coated in a dry layer thickness of 1μ.

Eleventh Layer (First Protective Layer)

A 10% aqueous gelatin solution containing a finely divided silver iodobromide emulsion (grain size: 0.15μ; iodine content: 1 mol%) which had not been chemically sensitized was coated so that the amount of silver coated was 0.3 g/m$^2$ and the dry layer thickness was 1μ.

Films B and C

Films B and C were prepared, which were the same as Film A except that emulsions containing Compounds (1) and (8) of the present invention, respectively, in place of di-tert-octylhydroquinone were used in the preparation of the third, sixth and tenth layers.

These Films A, B and C were exposed to red light through a wedge continuously varying in gray density and then were subjected to the following reversal development:

| Step | Time (min) | Temperature (°C.) |
|---|---|---|
| First development | 6 | 38 |
| Rinsing | 2 | " |
| Reversion | 2 | " |
| Color development | 6 | " |
| Adjustment | 2 | " |
| Bleaching | 6 | " |
| Fixing | 4 | " |
| Rinsing | 4 | " |
| Stabilization | 1 | Room temperature |
| Drying | | |

The composition of the processing solutions was as follows:

| | |
|---|---|
| First Developer | |
| Water | 700 ml |
| Sodium tetrapolyphosphate | 2 g |
| Sodium sulfite | 20 g |
| Hydroquinone monosulfonate | 30 g |
| Sodium carbonate (monohydrate) | 30 g |
| 1-Phenyl-4-methyl-4-hydroxylmethyl-3-pyrazolidone | 2 g |
| Potassium bromide | 2.5 g |
| Potassium thiocyanate | 1.2 g |
| Potassium iodide (0.1% solution) | 2 ml |
| Water to make | 1,000 ml (pH, 10.1) |
| Reversal Solution | |
| Water | 700 ml |
| Nitrilo-N,N,N—trimethylene phosphonic acid 6 Na salt | 3 g |
| Stannous chloride (dihydrate) | 1 g |
| p-Aminophenol | 0.1 g |
| Sodium hydroxide | 8 g |
| Glacial acetic acid | 15 ml |
| Water to make | 1,000 ml |
| Color Developer | |
| Water | 700 ml |
| Sodium tetrapolyphosphate | 2 g |
| Sodium sulfite | 7 g |
| Sodium triphosphate (12 hydrate) | 36 g |
| Potassium bromide | 1 g |
| Potassium iodide (0.1% solution) | 90 ml |
| Sodium hydroxide | 3 g |

-continued

| | |
|---|---|
| Citrazinic acid | 15 g |
| N—Ethyl-N—(β-methanesulfonamido-ethyl)-3-methyl-4-aminoaniline sulfate | 11 g |
| Ethylenediamine | 3 g |
| Water to make | 1,000 ml |
| Adjusting Solution | |
| Water | 700 ml |
| Sodium sulfite | 12 g |
| Sodium ethylenediaminetetra-acetate (dihydrate) | 8 g |
| Thioglycerin | 0.4 ml |
| Glacial acetic acid | 3 ml |
| Water to make | 1,000 ml |
| Bleaching Solution | |
| Water | 800 ml |
| Sodium ethylenediaminetetra-acetate (dihydrate) | 2.0 g |
| Iron (III) ammonium ethylenediamine-tetraacetate (dihydrate) | 120.0 g |
| Potassium bromide | 100.0 g |
| Water to make | 1,000 ml |
| Fixing Solution | |
| Water | 800 ml |
| Ammonium thiosulfate | 80.0 g |
| Sodium sulfite | 5.0 g |
| Sodium hydrogen sulfite | 5.0 g |
| Water to make | 1,000 ml |
| Stabilizer | |
| Water | 800 ml |
| Formalin (37% by weight) | 5.0 ml |
| Fuji Dry Well | 5.0 ml |
| Water to make | 1,000 ml |

Each developed film was measured for density by the use of a red filter to determine the maximum color density (Dmax) and minimum color density (Dmin). Also the maximum color densities of the blue-sensitive and green-sensitive layers were measured by the use of a blue filter and a green filter, respectively. The results are shown in Table 3 below.

TABLE 3

| Film No. | Red-Sensitive Layer Dmax | Red-Sensitive Layer Dmin | Green-Sensitive Layer Dmax | Blue-Sensitive Layer Dmax |
|---|---|---|---|---|
| A (comparative example) | 2.98 | 0.43 | 2.63 | 2.85 |
| B (example of the invention) | 2.88 | 0.38 | 2.59 | 2.71 |
| C (example of the invention) | 2.85 | 0.39 | 2.61 | 2.76 |

It can be seen from Table 3 that when the compounds of the present invention are used, the minimum density value drops. This demonstrates that color stain is prevented by using the compounds of the present invention.

While the invention has been described in detail and with reference to specific embodiments thereof, it will be apparent to one skilled in the art that various changes and modifications can be made therein without departing from the spirit and the scope thereof.

What is claimed is:

1. A color photographic silver halide light-sensitive material characterized by containing as a color stain inhibitor a compound comprising a phenol or naphthol ring with at least one substituted or unsubstituted sulfamoylamino group substituted in the ring.

2. The material as claimed in claim 1, wherein the compound is represented by the general formula (I):

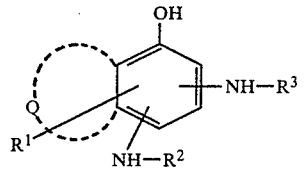

(I)

wherein:

$R^1$ is a hydrogen atom, a halogen atom, or an alkyl group, an alkoxyl group, an acylamino group, an alkylthio group, an alkoxycarbonyl group, an aryloxycarbonyl group, a sulfamoylamino group, a carbamoylamino group, an arylsulfoneamide group, an alkylsulfoneamide group, an acyl group, a sulfonyl group, or a carbamoyl group, which all may be substituted or unsubstituted;

$R^2$ and $R^3$ are each an arylsulfonyl group, an alkylsulfonyl group, or a sulfamoyl group and may be substituted or unsubstituted, provided that when $R^1$ is not a substituted or unsubstituted sulfamoylamino group, at least one of $R^2$ and $R^3$ is a substituted or unsubstituted sulfamoyl group; and Q represents atoms to form a phenol ring in combination with a ring substituted with a OH group, or an atomic group to form a naphthol ring in combination with a ring substituted with a OH group.

3. The material as claimed in claim 1, wherein the compound is selected from compounds represented by general formulae II-V set forth below:

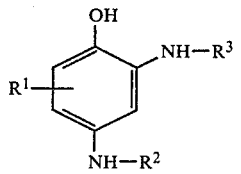

(II)

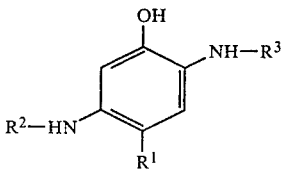

(III)

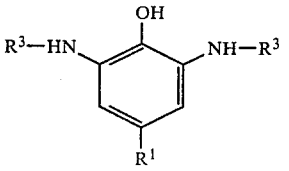

(IV)

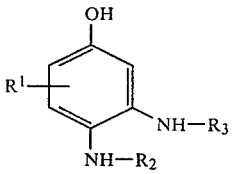

(V)

wherein $R^1$, $R^2$ and $R^3$ are as defined in the general formula (I).

4. The material as claimed in claim 1 wherein said compound is employed in an intermediate layer in an amount of from $1.0\times10^{-3}$ to $1.0\times10^{-5}$ mol/m$^2$ per layer.

5. The material as claimed in claim 1, wherein said compound is used in an emulsion layer in an amount of from $1.0\times10^{-4}$ to $1.0\times10^{-6}$ mol/m$^2$ per layer.

6. The material as claimed in claim 1, wherein said compound is employed in both an intermediate layer and an emulsion layer.

7. The material as claimed in claim 3, wherein said compound has general formula (II).

8. The material as claimed in claim 3, wherein said compound has general formula (III).

9. The material as claimed in claim 3, wherein said compound has general formula (IV).

10. The material as claimed in claim 3, wherein said compound has general formula (V).

11. The material as claimed in claim 3, wherein the compounds of general formula (I) to (V) have a total number of carbon atoms in $R_1$, $R_2$ and $R_3$ of at least 10.

12. The material as claimed in claim 3, wherein in general formulae (II) or (V) $R_1$ is a hydrogen atom, an alkyl group, an alkoxyl group, a halogen atom, an acyl group, an alkylthio group, an alkoxycarbonyl group, an aryloxycarbonyl group or a carbamoyl group.

13. The material as claimed in claim 3, wherein in general formulae (III) and (IV) $R_1$ is a hydrogen atom, an alkyl group, an alkoxycarbonyl group, an aryloxycarbonyl group, an acyl group or a carbamoyl group.

* * * * *